US005725163A

United States Patent [19]

Eloranta et al.

[11] Patent Number: 5,725,163

[45] Date of Patent: Mar. 10, 1998

[54] HYDRAULIC CONTROL SYSTEM FOR GYRATORY CRUSHER PROVIDED WITH SAFETY SYSTEM FOR OVERLOAD CONDITIONS

[75] Inventors: Jarmo Eloranta, Pirkkala; Kari Rikkonen, Tampere, both of Finland

[73] Assignee: Nordberg-Lokomo OY, Tampere, Finland

[21] Appl. No.: 669,460

[22] PCT Filed: Jan. 16, 1995

[86] PCT No.: PCT/FI95/00015

§ 371 Date: Jul. 9, 1996

§ 102(e) Date: Jul. 9, 1996

[87] PCT Pub. No.: WO95/19224

PCT Pub. Date: Jul. 20, 1995

[30] Foreign Application Priority Data

Jan. 17, 1994 [FI] Finland ..... 940288

[51] Int. Cl.[6] ..... B02C 2/04

[52] U.S. Cl. ..... 241/33; 241/213; 241/207; 241/37

[58] Field of Search ..... 241/209, 207, 241/213, 37, 33

[56] References Cited

U.S. PATENT DOCUMENTS

| | | | |
|---|---|---|---|
| 2,022,135 | 11/1935 | Newhouse | 241/37 X |
| 3,117,734 | 1/1964 | McCarty et al. | 241/37 X |
| 3,133,706 | 5/1964 | Mertz | 241/37 X |
| 3,133,707 | 5/1964 | Zimmerman | 241/213 X |
| 3,328,888 | 7/1967 | Geischen et al. | 241/37 X |
| 3,928,796 | 12/1975 | Kaiser | 241/37 X |
| 4,016,630 | 4/1977 | Bengtsson et al. | 241/207 |
| 4,027,825 | 6/1977 | Coxhill | 241/213 |
| 4,187,991 | 2/1980 | Petrini | 241/207 X |
| 4,339,087 | 7/1982 | Pollak | 241/207 X |
| 4,372,496 | 2/1983 | Maliszewski | 241/37 |
| 4,399,087 | 7/1982 | Pollak | 241/211 |
| 4,792,099 | 12/1988 | Hatch et al. | 241/33 X |
| 4,793,560 | 12/1988 | Schrodl | 241/207 X |
| 4,856,716 | 8/1989 | Burstedt | 241/37 X |
| 4,976,470 | 12/1990 | Arakawa | 241/37 |

FOREIGN PATENT DOCUMENTS

| | | | |
|---|---|---|---|
| 178818 | 4/1962 | Sweden | 241/207 |
| 8705828 | 10/1987 | WIPO | 241/207 |

*Primary Examiner*—Daniel W. Howell
*Assistant Examiner*—Julie A. Krolikowski
*Attorney, Agent, or Firm*—Burns, Doane, Swecker & Mathis, L.L.P.

[57] ABSTRACT

A hydraulic control system for a gyratory crusher has a hydraulically supported main shaft. An inlet line to the cylinder is provided with a pressure relief valve. When the pressure in the cylinder, e.g. because of a disturbance, exceeds the opening pressure of the relief valve, fluid flows from the cylinder through the pressure relief valve to the lubricating circuit of the crusher and further to the return line. The safety system of the crusher is simple, reliable, and quick.

7 Claims, 2 Drawing Sheets

HYDRAULIC CONTROL SYSTEM FOR GYRATORY CRUSHER PROVIDED WITH SAFETY SYSTEM FOR OVERLOAD CONDITIONS

FIELD OF THE INVENTION

The present invention relates to a hydraulic control system of gyratory crushers. The invention relates especially to a safety system for overload situations in such crushers where the main shaft is hydraulically supported by a piston.

BACKGROUND OF THE INVENTION

The main shaft of a gyratory crusher is usually hydraulically supported by a piston such that the vertical position of the main shaft can be adjusted. The hydraulic circuit in such crushers is usually also provided with a safety system for overload situations. When a noncrushable particle enters the crusher, the system allows the piston and thereby the main shaft to move downwards and thus let the particle go through the crusher. Thereafter the main shaft must rise to the original position to continue the crushing process. In such known systems there is a pressure relief valve and a pressure accumulator. Pressure accumulators are however quite expensive and they require a relatively large space. They also have to be checked relatively often.

SUMMARY OF THE INVENTION

Now a hydraulic control system for gyratory crushes has been invented. Preferable embodiments of the invention are described in the other claims.

In the invention it is essential that in an overload situation the pressure relief valve allows the fluid to flow from the cylinder to the lubricating circuit of the crusher, and thus makes the main shaft to move downwards. When, after the disturbance, an automatic control system reacts to this movement and pumps fluid back to the crusher, and thus lifts the main shaft to the pre-determined position. No pressure accumulator and no corresponding hoses are needed.

According to a preferable embodiment, the pressure relief valve is integrated to or into the crusher.

BRIEF DESCRIPTION OF THE EXAMING FIGURES

In the drawings of the description,

DETAILED DESCRIPTION OF THE INVENTION

Figure 1:
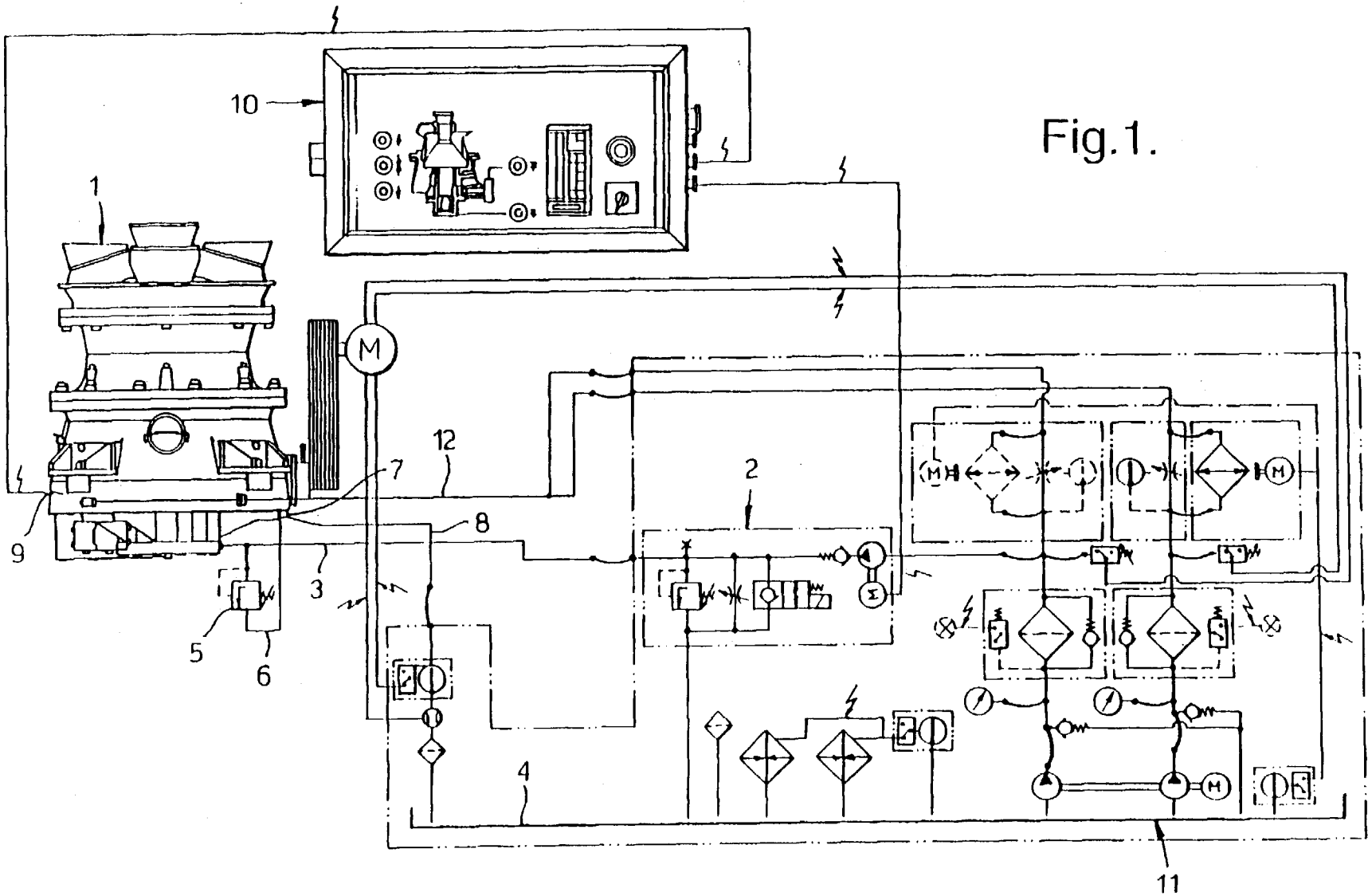
FIG. 1 shows the hydraulic scheme of a system in accordance with the invention.

Crusher 1 comprises a frame and therein a main shaft supported through a suitable bearing by a piston movable in a hydraulic cylinder. The main shaft can be kept at a desired position by adjusting the amount of hydraulic fluid in the cylinder. Pressurized fluid is led from pump unit 2 through inlet line 3 into the cylinder to support the piston and thereby the main shaft. The fluid is normally led out from the cylinder through the line 3 and adjusting means of the pump unit into tank 4. The pump unit then takes fluid from the tank.

The inlet line 3 is provided with a pressure relief valve 5 integrated to or preferably into the crusher. In case of an overload situation in the crusher, for instance because of an uncrushable particle, overpressure in the cylinder opens the relief valve, and fluid flows from the inlet line through a by-pass line 61and outlet 7 to return line 8.

The crusher is also provided with a setting transducer 9, which detects the change of the main shaft position. When an overload situation is over, the shaft is automatically raised to the original position. The process is controlled by means of control unit 10 connected to the pump unit and to the transducer.

Because there is no pressure accumulator, the system is simpler, more compact and easier to assemble than the known systems. Further, when the relief valve is joined without hoses to the crusher, the system response times are very short. This is an important advantage especially in cold climates, where the resistance in hoses is even more significant. In an overload situation there is also no counterpressure to the oil, which further increases the efficiency and reliability of the system. Also the service demand is reduced.

The setting transducer 9 may comprise of a toothed rack attached to the piston and of a corresponding gear wheel connected to a angle detector.

As normally, hydraulic fluid is used here also as a lubricating oil. Fluid is taken from the tank 4 by a lubrication pump unit 11 and led into the crusher lubricating circuit through a lubrication inlet line 12. From the lubricating oil circuit the fluid is returned through the outlet 7 to the return line 8.

The pump unit 2, tank 4, and lubrication pump unit 11, are provided with normal auxiliary equipment necessary for reliable operation of such systems.

Figure 2:
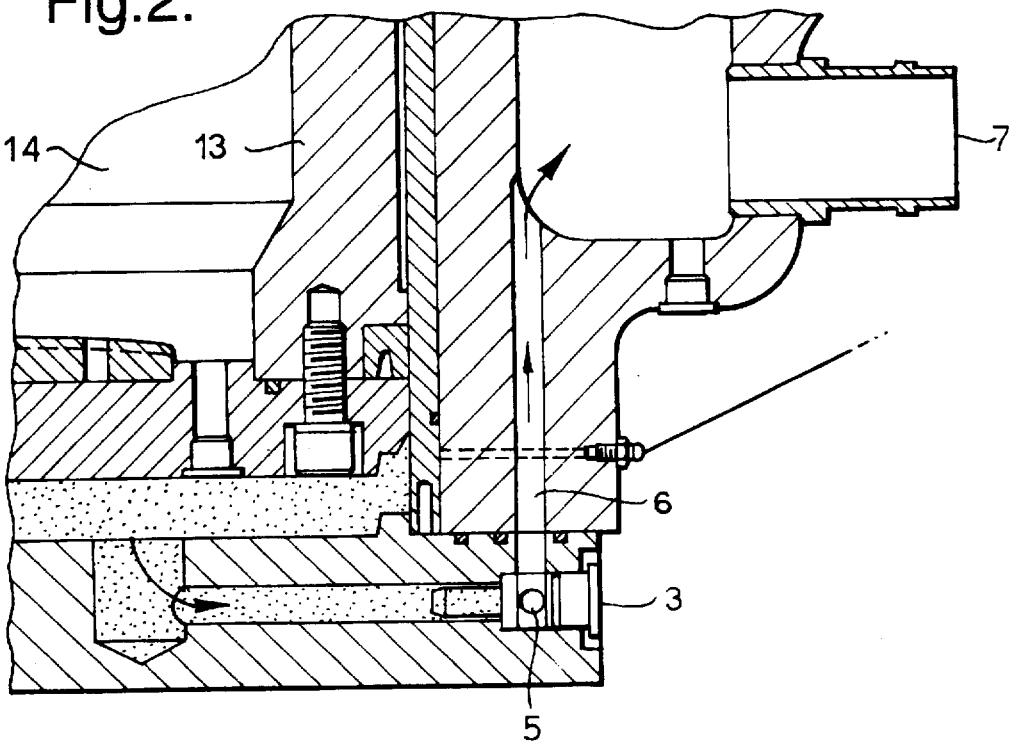
FIG. 2 shows a partial sectional view of a crusher that can be used in the system of FIG. 1.

FIG. 2 shows in more detail how the relief valve 5 is mounted into the frame of the crusher. The by-pass line 6 has been made into the frame so as to lead from the valve 5 into the lubrication circuit. In a normal situation the stem of the valve closes the by-pass line. In an overload situation the stem moves backwards and allows fluid to flow into the by-pass line.

Alternatively, an external by-pass line can be used.

FIG. 2 also shows a cuplike piston 13 surrounding the main shaft 14. In this way the height of the crusher is lower than in conventional crushers with a piston-cylinder pair totally below the main shaft. The present invention can of course be applied also to conventional crushers.

Figure 3:
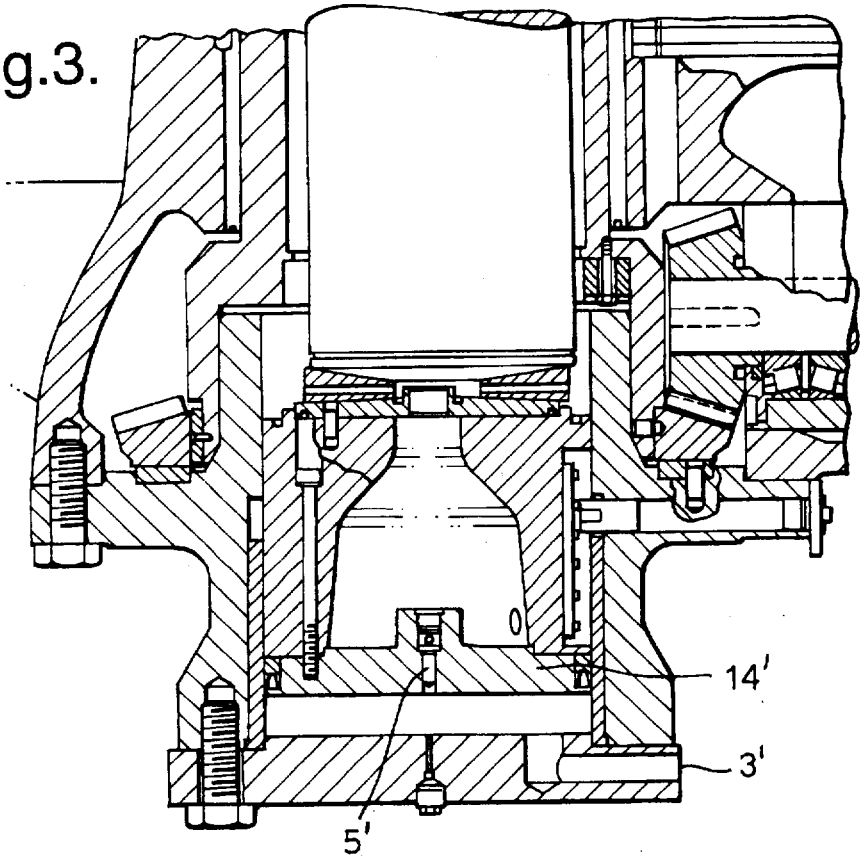
FIG. 3 shows a partial sectional view of another crusher.

FIG. 3 shows an embodiment in which relief valve 5' has been placed in a conventional piston 14'. In an overload situation fluid flows from the cylinder through the relief valve into the lubrication circuit.

We claim:

1. A hydraulic control system for a gyratory crusher in which a main shaft of the crusher is supported hydraulically by a piston movable in a cylinder and the crusher is lubricated by a lubricating circuit, the system comprising:

a tank for hydraulic fluid, a pump unit and inlet lines which lead hydraulic fluid from the tank into the cylinder and into the lubricating circuit, a return line which leads hydraulic fluid from the cylinder and from the lubricating circuit into the tank, and a pressure relief valve connected to the inlet line and having associated therewith an opening pressure at which the relief valve opens, and a by-pass line connected between the relief valve and lubricating circuit, such that when the pressure in the cylinder exceeds the opening pressure of the relief valve, fluid flows from the cylinder through the relief valve to the lubricating circuit and further to the return line.

2. A system in accordance with claim 1, wherein the by-pass line is integrated the crusher.

3. A system in accordance with claim 2, further comprising a transducer which monitors a height position of the main shaft in the crusher, and a control unit connected to the transducer and to the pump unit such that when the pressure in the cylinder is below the opening pressure of the relief valve, the control unit operates the pump unit to automatically position the main shaft at a predetermined position.

4. A system in accordance with claim 2, wherein the by-pass line is placed in the frame of the crusher.

5. A system in accordance with claim 4, further comprising a transducer which monitors a height position of the main shaft in the crusher, and a control unit connected to the transducer and to the pump unit such that when the pressure in the cylinder is below the opening pressure of the relief valve, the control unit operates the pump unit to automatically position the main shaft at a predetermined position.

6. A system in accordance with claim 1, further comprising a transducer which monitors a height position of the main shaft in the crusher, and a control unit connected to the transducer and to the pump unit such that when the pressure in the cylinder is below the opening pressure of the relief valve, the control unit operates the pump unit to automatically position the main shaft at a predetermined position.

7. A system in accordance with claim 1, wherein the pressure relief valve is integrated into the crusher.

* * * * *